US007028432B2

(12) United States Patent
Manos et al.

(10) Patent No.: US 7,028,432 B2
(45) Date of Patent: Apr. 18, 2006

(54) COMPACT CEILING ISOLATION HANGER

(75) Inventors: Steven P. Manos, Blacklick, OH (US); Matthew Swysgood, Galena, OH (US)

(73) Assignee: Kinetics Noise Control, Inc., Dublin, OH (US)

( * ) Notice: Subject to any disclaimer, the term of this patent is extended or adjusted under 35 U.S.C. 154(b) by 0 days.

(21) Appl. No.: 10/429,538

(22) Filed: May 3, 2003

(65) Prior Publication Data

US 2004/0216398 A1 Nov. 4, 2004

(51) Int. Cl.
*E04B 1/98* (2006.01)

(52) U.S. Cl. ..... 52/167.1; 52/167.7; 52/506.8; 52/747.1; 248/343

(58) Field of Classification Search ..... 52/167.1, 52/506.06, 506.08, 512, 167.4, 167.7, 220.6, 52/506.9, 664–666, 733.1, 747.1, 506.8; 248/343, 317

See application file for complete search history.

(56) References Cited

U.S. PATENT DOCUMENTS 2,359,917 A * 10/1944 Hussman ..... 267/140.11
2,660,386 A * 11/1953 Munro ..... 248/574
4,599,834 A * 7/1986 Fujimoto et al. ..... 52/167.8
5,103,605 A * 4/1992 Sul ..... 52/167.1
5,201,155 A * 4/1993 Shimoda et al. ..... 52/167.7
5,456,047 A * 10/1995 Dorka ..... 52/167.4
5,992,582 A * 11/1999 Lou et al. ..... 188/267.1
6,561,726 B1 * 5/2003 Hecken et al. ..... 403/389
6,598,365 B1 * 7/2003 Abraham et al. ..... 52/403.1

FOREIGN PATENT DOCUMENTS

EP 557979 A1 * 9/1993
JP 03132550 A * 6/1991
JP 08054042 A * 2/1996

OTHER PUBLICATIONS

Vehicle Mountings and Controls, VMC: Series ASCM Sping-Flex Seismic Isolators, Jul. 1997 http://www.aeroflex.com/products/isolator/isolator.cfm.*

(Continued)

*Primary Examiner*—Winnie Yip
(74) *Attorney, Agent, or Firm*—Kathleen K Bowen

(57) ABSTRACT

A compact ceiling isolation hanger for suspending and isolating a ceiling from the ceiling structure comprises two vibration isolators, two vibration isolator mounting means, a channel bracket having a channel carrier and opposing flanges, and a ceiling bracket mounted to the ceiling structure, wherein the vibration isolator mounting means mount the vibration isolators and the channel bracket to the ceiling bracket such that the vibration isolator mounting means pass through the channel bracket flanges, and wherein the ceiling bracket is adapted such that the vibration isolator mounting means do not contact the ceiling structure.

23 Claims, 5 Drawing Sheets

OTHER PUBLICATIONS

Vehicle Mountings and Controls, VMC: Series AWRS Spring-Flex Restrained Isolators, Nov. 1998.*
Vehicle Mountings and Controls, VMC: "P" Series Curbs; "R" Series Rails, Dec. 1998.*
Vehicle Mountings and Controls, VMC: Spring-FLex Hangers Series SH/RSH, Apr. 2000.*
Vehicle Mountings and Controls, VMC: Neoprene Hangers Series RH/RHD.*
Vehicle Mountings and Controls, VMC: Spring-Flex Moutnings Series A/U.*
VMC Architectural Products, Series LP, Low Profile Ceiling Isolation Hangers (Bulletin LP/99).

* cited by examiner

COMPACT CEILING ISOLATION HANGER

BACKGROUND

The present invention is in the field of suspended and isolated ceilings. More specifically this invention relates to a hanging device for suspending and isolating a ceiling.

In modern construction, especially commercial and institutional building construction, suspended ceilings using a hanger mechanism are very common. This type of construction is used both to minimize the effects from impact (structure-borne noise) and reduce sound transmission (air-borne noise) between occupied spaces. To further reduce structure-borne and air-borne noise transmitted from one occupied space to another, the hangers used to suspend the ceiling are often equipped with vibration isolators. In the past, these vibration isolation hangers, typically a spring assembly, have consisted of an attachment mechanism from which single or multiple layers of gypsum board are suspended. Another attachment mechanism is used to mount the vibration isolation hanger to a component of the ceiling structure above the hanger. This method typically requires 7–13 inches of space, which for many applications is unacceptable.

In addition to the undesirable amount of space used, these hangers provide no inherent lateral or vertical restraint as may be required during a seismic event. To prepare for the occurrence of a seismic event when lateral and vertical movement is an issue, a separate restraint must be installed. Further, there is no easy way to level the ceiling framing system in the field if adjustments are necessary.

In an attempt to overcome some of these shortcomings, Vibration Mountings and Controls, Inc. developed a low profile ceiling isolation hanger. Their design consists of a vibration isolator supporting opposing receiver arms on either side of the vibration isolator. These receiver arms then support two cold rolled steel channels (one each), which in turn support the isolated ceiling. While this design does indeed reduce the required space, it requires two cold rolled steel channels, which increases isolated ceiling grid materials costs. Further, it does not solve the problem of easily leveling the ceiling grid if any adjustments are needed in the field.

A compact ceiling isolation hanger is desired which would take up a minimum of space, require less ceiling grid material, limit lateral and vertical movement of the suspended and isolated ceiling assembly, and allow for easy leveling of the ceiling grid in the field.

SUMMARY OF THE INVENTION

A compact ceiling isolation hanger for suspending and isolating a ceiling from the ceiling structure comprises two vibration isolators, two vibration isolator mounting means, a channel bracket having a channel carrier and opposing flanges, and a ceiling bracket mounted to the ceiling structure, wherein the vibration isolator mounting means mount the vibration isolators and the channel bracket to the ceiling bracket such that the vibration isolator mounting means pass through the channel bracket flanges, and wherein the ceiling bracket is adapted such that the vibration isolator mounting means do not contact the ceiling structure.

DETAILED DESCRIPTION

Figure 1:
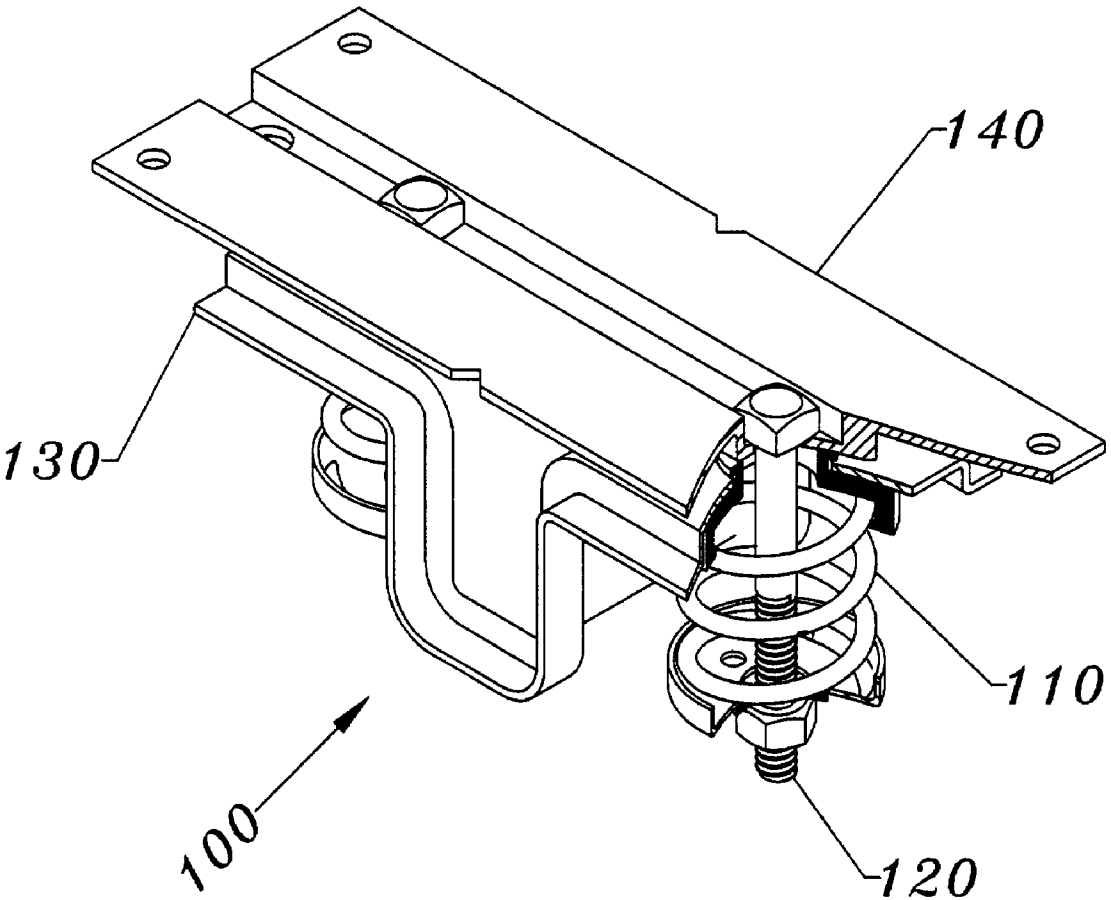
FIG. 1 is an isometric view of a compact ceiling isolation hanger according to an aspect of the invention.
Figures 2, 2A:
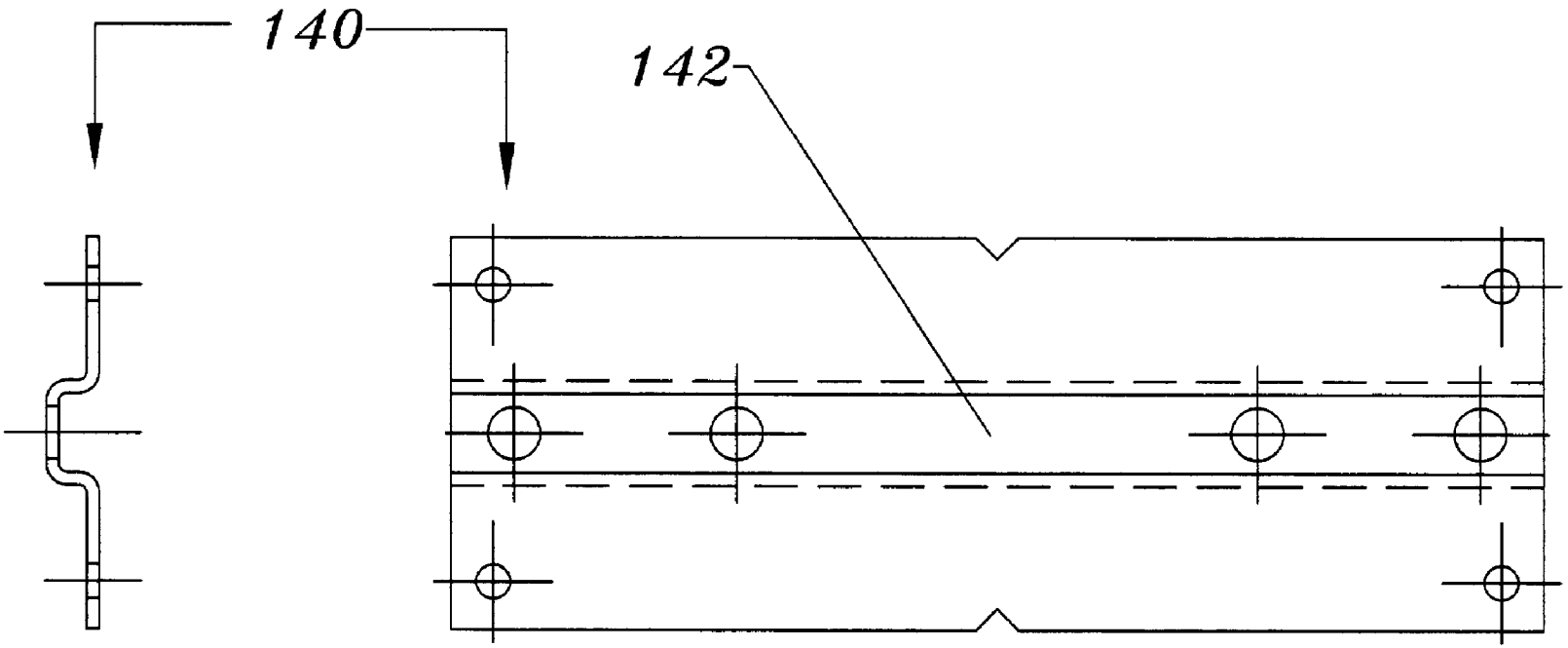
FIG. 2 is a top view of a ceiling bracket, according to an aspect of the invention.
FIG. 2A is an end view of a ceiling bracket, according to an aspect of the invention.
Figure 3:
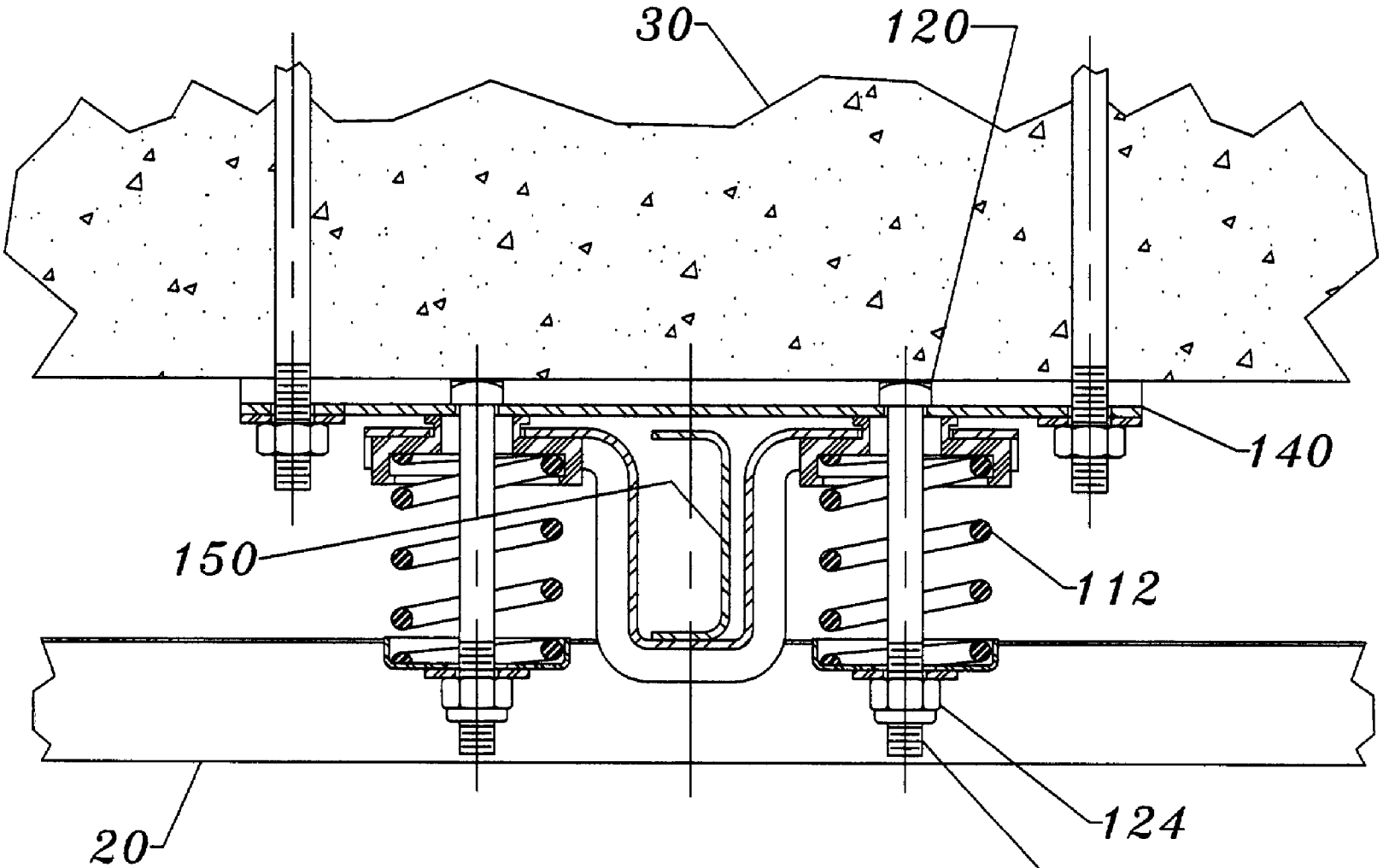
FIG. 3 is a side view of an installed compact ceiling isolation hanger according to an aspect of the invention.
Figure 4:
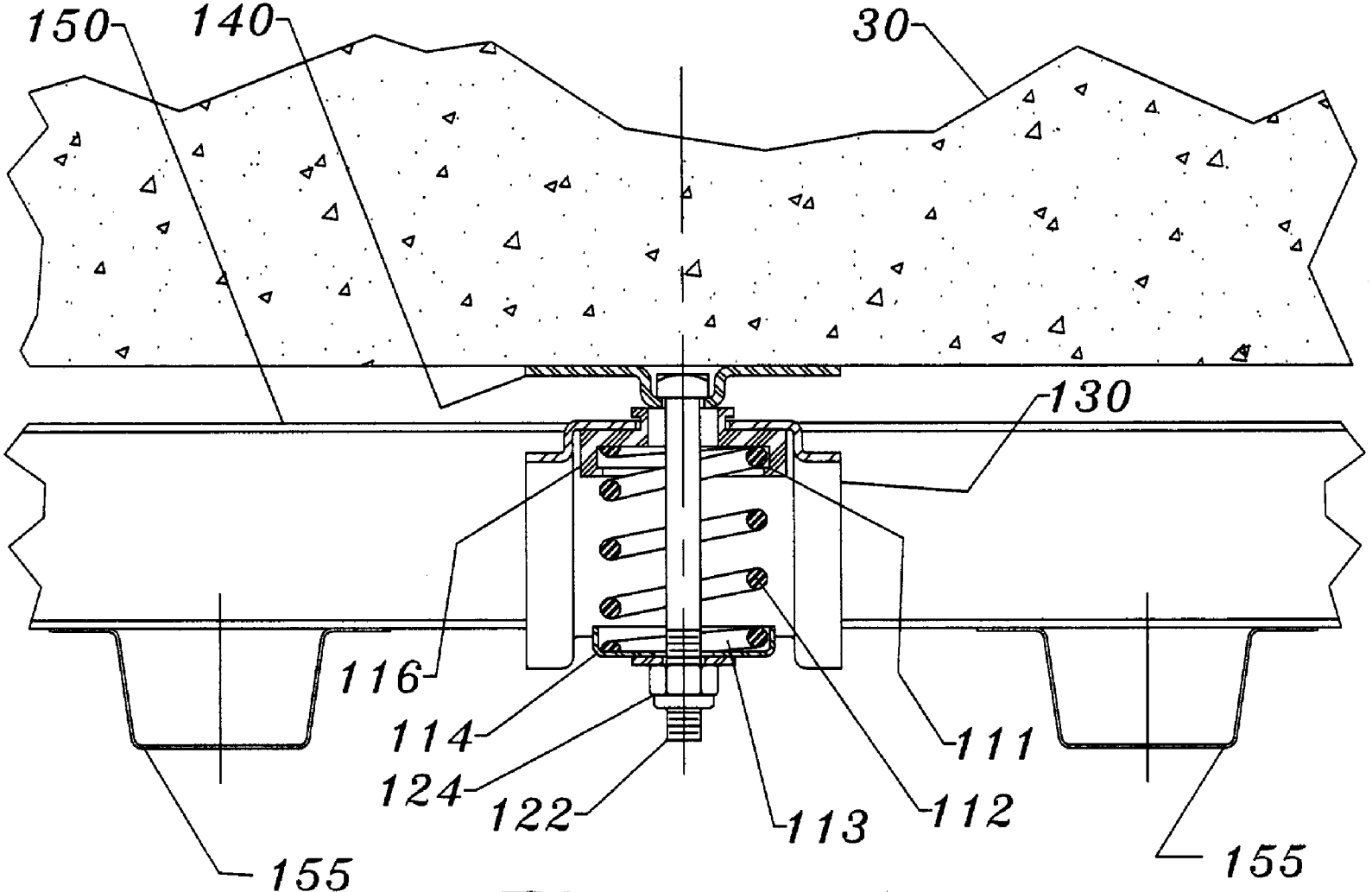
FIG. 4 is an end view of an installed compact ceiling isolation hanger according to an aspect of the invention.

Various aspects of the invention are presented in FIGS. 1-5 which are not drawn to scale and in which like components are numbered alike. Referring now to FIGS. 1–5, according to an aspect of the invention, a compact ceiling isolation hanger 100 for suspending and isolating a ceiling 20 from a ceiling structure 30 comprises two vibration isolators 110, two vibration isolator mounting means 120, a channel bracket 130, and a ceiling bracket 140. The channel bracket 130 has a channel carrier 132, and opposing flanges 134, one on either side of the channel carrier 132, and is supported by the vibration isolators 110. The ceiling bracket 140 is mounted to the ceiling structure 30. The vibration isolator mounting means 120 mount the vibration isolators 110 to the ceiling bracket 140, such that the vibration isolator mounting means 120 pass through the channel bracket flanges 134. The ceiling bracket 140 is adapted such that when installed, the vibration isolator mounting means 120 do not contact the ceiling structure.

According to a further aspect of the invention, the ceiling bracket 140 is adapted by having a channel 142, such that the vibration isolator mounting means 120 mounts into the channel 142.

In a further aspect of the invention the channel bracket 130 is mounted such that the flanges 134 are located between the vibration isolators 110 and the ceiling bracket 140.

In one embodiment of the invention the vibration isolators 110 comprise elastomeric elements such as neoprene or natural rubber. In another embodiment the vibration isolators 110 comprise springs. In a third embodiment of the invention the vibration isolators 110 comprise compressed fiberglass elements. These are three examples of commonly used vibration isolators; this does not in any way limit the invention, as any suitable vibration isolator is considered to be within the purview of this invention.

In a preferred embodiment of the invention, the vibration isolators 110 comprise springs 112 having a top end 111 and a bottom end 113, and further comprise an isolating spring cup 116, wherein the isolating spring cup 116 is on the top end 111, and a spring cap 114 wherein the spring cap 114 is on the bottom end 113. The isolating spring cup 116 serves to reduce the transfer of noise through the metal components. In a further preferred embodiment, the isolating spring cup 116 comprises an elastomeric material.

According to another aspect of the invention, the vibration isolator mounting means 120 each comprise a bolt 122 and a nut 124. In a preferred embodiment, the ceiling 20 may be leveled by loosening or tightening the nut 124.

According to another aspect of the invention, the vibration isolator mounting means 120 each comprise a bolt 122 and a nut 124. In a preferred embodiment, lateral and vertical movement of the ceiling 20 may be limited during a seismic occurrence.

Figure 5:
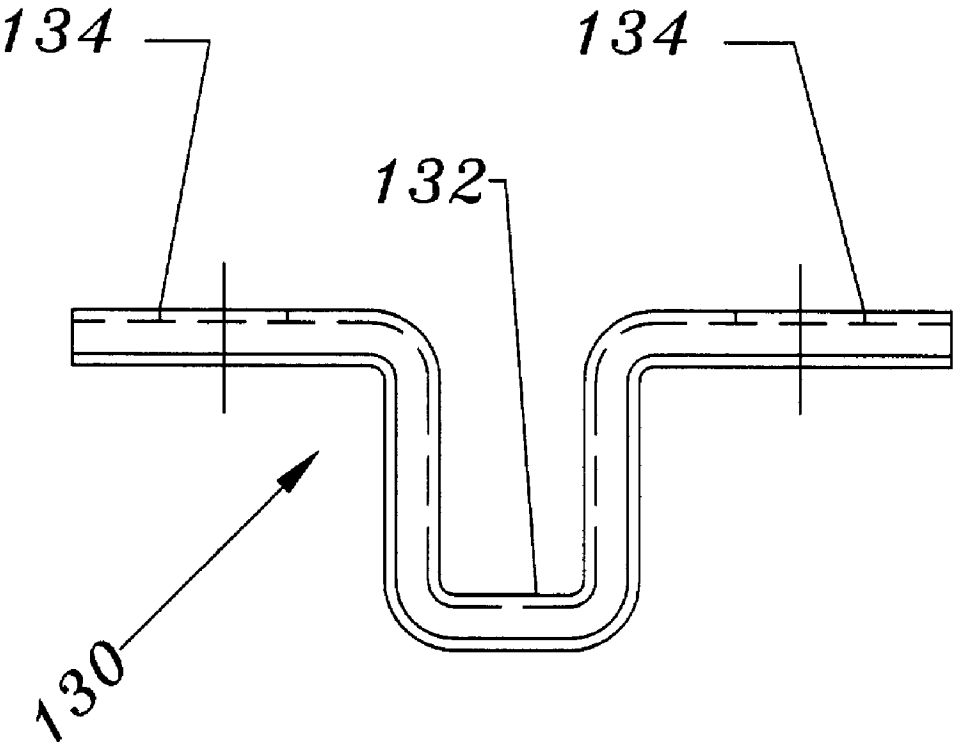
FIG. 5 is a side view of a channel bracket according to an aspect of the invention.
Figure 5A:
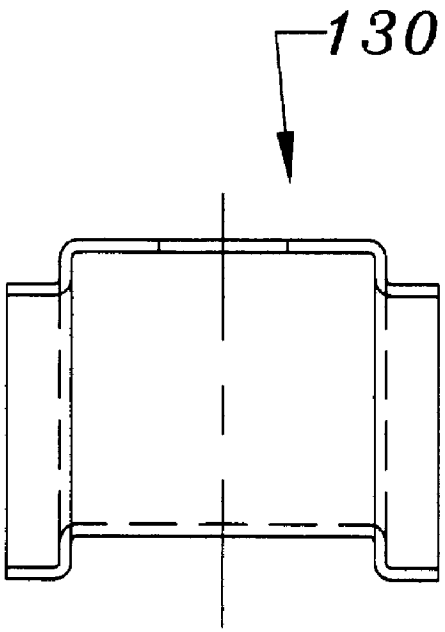
FIG. 5A is an end view of a channel bracket according to an aspect of the invention.

Referring now to FIGS. 5 and 5A, in a further preferred embodiment, the channel bracket 130 has a hat-shaped cross-section. This increases the strength of the channel bracket 130 allowing for the use of a bracket that requires less space than would be needed otherwise.

According to another aspect of the invention, a method for suspending and isolating a floating ceiling 20 from a ceiling structure 30 comprises supporting a channel bracket 130 having a channel carrier 132 and two opposing flanges 134, with two vibration isolators 110, mounting the vibration isolators 110 to a ceiling bracket 140 with a vibration isolator mounting means 120, mounting the ceiling bracket 140 to the ceiling structure 30, wherein the ceiling bracket 140 is adapted such that the vibration isolator mounting means 120 do not contact the ceiling structure 30, sliding a cold rolled steel channel 150 into the channel carrier 132 of the channel bracket 130, and attaching the floating ceiling 20 to the cold rolled channel 150.

In a preferred embodiment, the floating ceiling 20 would be attached to the cold rolled channel 150 by attaching an appropriate mounting channel 155 to the cold rolled steel channel 150; and attaching the floating ceiling 20 to a ceiling grid comprised of the cold rolled steel channel 150 and the mounting channel 155. One such appropriate mounting channel 155 is a drywall furring channel, although the method is not limited in any way to a drywall furring channel.

In a preferred embodiment, the vibration isolator mounting means 120 each comprise a bolt 122 and a nut 124, and the method further comprises the step of loosening or tightening the nut 124 to level the floating ceiling 20. If a mounting channel 155 is used to form a ceiling grid, then the loosening or tightening of the nut would level the ceiling grid, and thus level the floating ceiling 20. Further, the type of bolt 122 used can function to limit the lateral and vertical movement of the floating ceiling 20, and provide seismic stability.

One common type of ceiling which may be suspended and isolated using the compact ceiling isolation hanger 100 is a gypsum board ceiling. Although any type of suspended ceiling is within the scope of this invention.

What is claimed is:

1. A compact ceiling isolation hanger for suspending and isolating a floating ceiling from a ceiling structure comprising:

two vibration isolators;

two vibration isolator mounting means;

a channel bracket having a channel carrier, and opposing flanges, wherein said channel bracket is supported by said vibration isolators;

a ceiling bracket mounted to the ceiling structure, wherein said vibration isolator mounting means mount said vibration isolators to said ceiling bracket such that said vibration isolator mounting means pass through said channel bracket flanges, and wherein said ceiling bracket is adapted such that said vibration isolator mounting means do not contact the ceiling structure.

2. The compact ceiling isolation hanger of claim 1 wherein said ceiling bracket is adapted by having a channel such that when said ceiling bracket is mounted flush with the ceiling, said vibration isolator mounting means mounts into said channel.

3. The compact ceiling isolation hanger of claim 1 wherein said channel bracket is mounted such that said flanges are located between said vibration isolators and said ceiling bracket.

4. The compact ceiling isolation hanger of claim 1 wherein said vibration isolators comprise elastomeric elements.

5. The compact ceiling isolation hanger of claim 1 wherein said vibration isolators comprise compressed fiber glass elements.

6. The compact ceiling isolation hanger of claim 1 wherein said vibration isolators comprise springs.

7. The compact ceiling isolation hanger of claim 1 wherein said vibration isolators comprise springs having a top end and a bottom end, and further comprising:

an isolating spring cup, wherein said isolating spring cup is on said top end; and, a spring cap wherein said spring cap is on said bottom end.

8. The compact ceiling isolation hanger of claim 7 wherein said isolating spring cup comprises an elastomeric material.

9. The compact ceiling isolation hanger of claim 1 wherein said vibration isolator mounting means each comprise a bolt and nut.

10. The compact ceiling isolation hanger of claim 1 wherein said vibration isolator mounting means each comprise a bolt and nut, and wherein the suspended and isolated ceiling may be leveled by loosening or tightening said nut.

11. The compact ceiling isolation hanger of claim 1 wherein said channel bracket has a hat-bracket-shaped cross-section.

12. A method for suspending and isolating a floating ceiling from a ceiling structure comprising:

supporting a channel bracket having a channel portion and two opposing flanges, with two vibration isolators;

mounting said vibration isolators to a ceiling bracket with a mounting means; such that said mounting means passes though said channelbracket flanges mounting said ceiling bracket to the ceiling structure, wherein said ceiling bracket is adapted such that said mounting means do not contact the ceiling structure;

sliding a cold rolled channel into said channel portion of said channel bracket; and, attaching the floating ceiling to said cold rolled channel.

13. The method of claim 12 wherein said floating ceiling is attached to said cold rolled channel by further comprising the steps:

attaching a mounting channel to said cold rolled channel to form a ceiling grid; and, attaching said floating ceiling to said ceiling grid.

14. The method of claim 12 wherein said ceiling bracket is adapted by having a channel such that said vibration isolator mounting means mounts into said channel.

15. The method of claim 12 wherein said channel bracket is mounted such that said flanges are located between said vibration isolators and said ceiling bracket.

16. The method of claim 12 wherein said vibration isolators comprise elastomeric elements.

17. The method of claim 12 wherein said vibration isolators comprise compressed fiber glass elements.

18. The method of claim 12 wherein said vibration isolators comprise springs.

19. The method of claim 12 wherein said vibration isolators comprise springs having a top end and a bottom end, and further comprise an isolating spring cup, wherein said isolating spring cup is on said top end; and, a spring cap wherein said spring cap is on said bottom end.

20. The method of claim 19 wherein said isolating spring cup comprises an elastomeric material.

21. The method of claim 12 wherein said vibration isolator mounting means each comprises a bolt and nut.

22. The method of claim 12 wherein said vibration isolator mounting means each comprises a bolt and nut, and further comprising the step:

loosening or tightening said nut to level the floating ceiling.

23. The method of claim 12 wherein said channel bracket has a hat-bracket-shaped cross-section.

* * * * *